United States Patent [19]

Jenkins

[11] 4,413,455

[45] Nov. 8, 1983

[54] BASE SUPPORT INSTALLATION FOR TRIPOD-TYPE STRUCTURES

[76] Inventor: Walter L. Jenkins, 236 Lafayette Rd., Syracuse, N.Y. 13205

[21] Appl. No.: 161,250

[22] Filed: Jun. 20, 1980

[51] Int. Cl.[3] ..... E02D 27/00

[52] U.S. Cl. ..... 52/295; 52/296; 248/346

[58] Field of Search ..... 52/116, 119, 120, 295, 52/296; 248/346, 679

[56] References Cited

U.S. PATENT DOCUMENTS

| | | | |
|---|---|---|---|
| 2,687,863 | 8/1954 | Vogt et al. | 52/120 X |
| 2,804,950 | 9/1957 | Leslie | 52/295 X |
| 3,144,375 | 8/1964 | Day | 52/295 X |
| 3,311,333 | 3/1967 | Galloway | 248/346 X |

FOREIGN PATENT DOCUMENTS

| | | | |
|---|---|---|---|
| 163507 | 9/1948 | Austria | 52/120 |
| 20093 | 4/1915 | Denmark | 248/679 |

*Primary Examiner*—William H. Schultz

[57] ABSTRACT

A base support installation for structures such as runway approach light towers to support the latter normally in a vertical orientation while permitting pivotal movement about a horizontal axis at or near the base to provide ground-level access to the upper end thereof. The support installation includes a concrete slab, a pair of brackets anchored to the slab, and a unitary, Y-shaped member pivotally attached at the extremities of two of its arms to the anchored brackets along a common axis. Mounting means for each of the three legs of the tower, or other supported structure, are provided at equally spaced positions on the three arms of the Y-shaped member. No potentially damaging or misaligning stresses are placed on the supported structure as it is moved about the pivotal mounting of the Y-shaped member and remains attached thereto to all three points.

9 Claims, 4 Drawing Figures

BASE SUPPORT INSTALLATION FOR TRIPOD-TYPE STRUCTURES

BACKGROUND OF THE INVENTION

The present invention relates to mounting or support installations providing a base for a tripod-type structure which is vertically oriented during normal use, but which must periodically be moved to a substantially horizontal orientation. More particularly, the invention relates to an installation intended to support a runway approach lighting tower, or similar structure, for essentially unstressed pivotal movement between upright and horizontal positions.

In many modern airports the terrain is such that runway approach lights must be supported on towers a considerable distance above ground level. Conventional towers are normally tripod-type structures which may have a single light at the top, or a horizontal bar supporting a plurality of lights. In any case, since the optical axis of the light or lamp must be in a predetermined orientation with respect to the intended approach path of incoming aircraft, it is necessary that the individual lamps be precisely positioned upon the supporting structure.

The major structural components of conventional approach light towers are of lightweight, frangible aluminum tubing so that, in the event a tower is struck by an approaching aircraft, the tower will be sheared off before causing serious structural damage to the aircraft. Consequently, the towers are not strong enough to support a person climbing to the top whereby, in order to reposition the lamps, the tower must be lowered to make the lamps manually accessible and adjustable from ground level. In conventional installations this is presently accomplished by mounting two of the three tower legs for pivotal movement, temporarily detaching the third tower leg from its mounting, and rotating the tower about the pivotal mounting of the two legs. Due to the additional weight and possible torsional forces applied to the pivotally mounted legs as the tower is lowered and raised, structural damage to the tower or misalignment problems may result.

It is a principal object of the present invention to provide a novel and improved base support installation for a tripod structure which must be moved about a horizontal axis at or near the tripod base.

A further object is to provide a pivotable support structure for a runway approach lighting tower which reduces the stress on tower structural components during movement between vertical and horizontal orientations.

Other objects will in part be obvious and will in part appear hereinafter.

SUMMARY OF THE INVENTION

In accordance with the foregoing objects, the invention contemplates an assembly which includes a slab of concrete, or the like, normally poured permanently into place on the site where the tower is to be erected. Three bolts are permanently embedded in the concrete slab at predetermined positions with threaded end portions projecting upwardly from the planar, horizontal upper surface of the slab. A pair of L-shaped brackets are connected to two of the bolts to provide anchored pivotal mounting means.

A rigid, unitary, Y-shaped member is pivotally connected at the extremities of two of its arms to the anchored brackets along a common horizontal axis, whereby the Y-shaped member may be rotated about the axis with respect to the slab. When positioned with one of its sides resting upon the flat upper surface of the slab, the Y-shaped member may be releasably attached to the slab by securing a nut on the threaded upper end of the third anchored bolt which passes through an opening in the Y-shaped member in this position.

Brackets are provided on each of the three arms of the Y-shaped member for attachment of the three legs of the tower or other supported structure. The attachment means may also provide for the passage of electrical wires from the base of the installation, through the hollow legs of the tower, to the lamps supported at the top. Means may also be provided for temporary or permanent connection of a lever arm for rotating the Y-shaped member, and thus the structure mounted thereon, about the horizontal axis through the two pivotally mounted extremities of the Y-shaped member.

DETAILED DESCRIPTION

Figure 1:
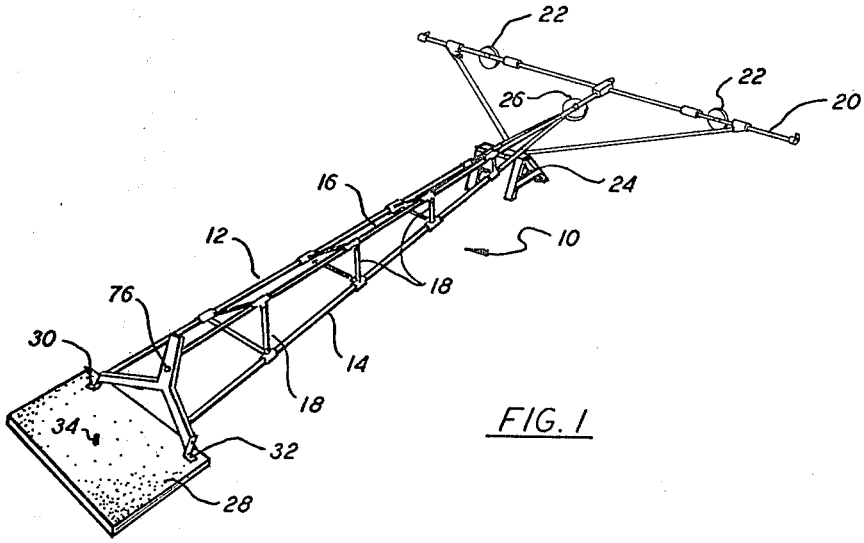
FIG. 1 is a perspective view showing a typical runway approach lighting tower in lowered position mounted upon the base support assembly of the present invention.
Figure 2:
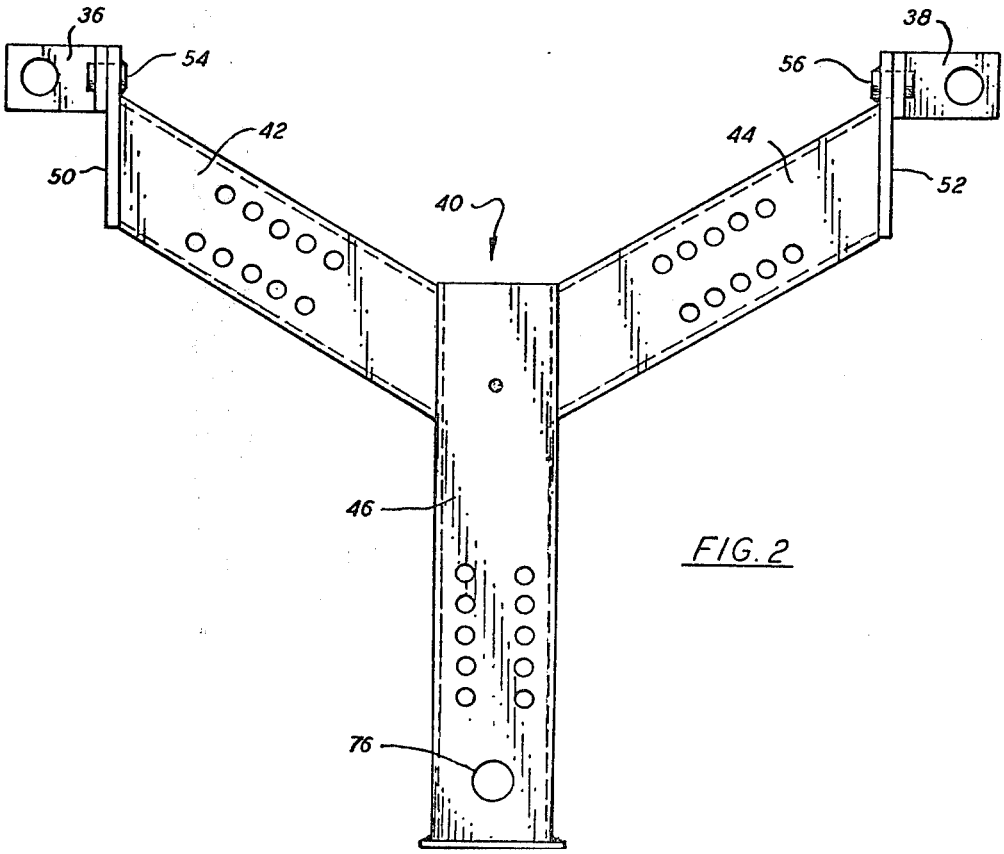
FIG. 2 is a plan view of the base support assembly.

Referring now to the drawings, in FIG. 1 is shown an airport runway approach lighting tower designated generally by reference numeral 10. Tower 10 is of conventional, tripod-type construction having three legs 12, 14, and 16, converging from the base toward the upper end, and joined at several points along their length by stabilizing braces 18. Bar 20 is mounted atop tower 10 and supports a plurality of lamps 22 which are positioned to project a beam along an axis which is precisely aligned in a predetermined orientation to the runway and the path of aircraft approaching the runway.

As previously mentioned, the materials and construction of tower 10 are such that, should the tower be struck by an approaching aircraft, the tower will be sheared off rather than causing serious structural damage to the aircraft. Consequently, the tower may be misaligned or damaged if a person attempts to climb to the top to adjust the lamps. One of the most widely accepted practices for adjusting the lamps is to pivot the tower around its base, rendering the upper end accessible from ground level. Tower 10 is shown in FIG. 1 in the lowered position, resting on support 24 with pendulum-type angle measuring device 26 attached to a bar extending along the axis of the tower. A typical example of device 26 and a full description of the manner of its use in adjusting the positions of lamps 22 prior to returning tower 10 to its upright position may be found in U.S. Pat. No. 4,084,328 of Aurhur S. Shai, issued Apr. 18, 1978 and assigned to applicant's assignee.

Tower 10 is mounted upon the support structure of the present invention for movement between its upright and lowered positions. The support assembly includes a base slab 28, normally of concrete poured on site to remain permanently in position on the spot where tower 10 is to stand. Slab 28 has an essentially horizontal upper surface from which extend three lugs or threaded bars 30, 32 and 34, the lower portions of which are permanently embedded in the concrete at predetermined distances from one another. A pair of L-shaped brackets 36 and 38 are firmly secured to lugs 30 and 32, respectively, by means of washers and nuts 39 (FIG. 3) placed on the threaded ends of the lugs.

Lugs 30 and 32, together with associated brackets 36 and 38, provide an anchored mounting means for a Y-shaped member, denoted generally by reference numeral 40 and having three arms 42, 44 and 46, welded or otherwise permanently secured to render member 40 rigid and unitary. Flanges 48 extend along the edges of each of arms 42, 44 and 46 and have edges lying in a flat plane to rest upon the upper surface of slab 28 in a first position of member 40, as described later. Plates 50 and 52, having one or more openings therein, are permanently affixed to the extremities of arms 42 and 44, respectively.

Figure 3:
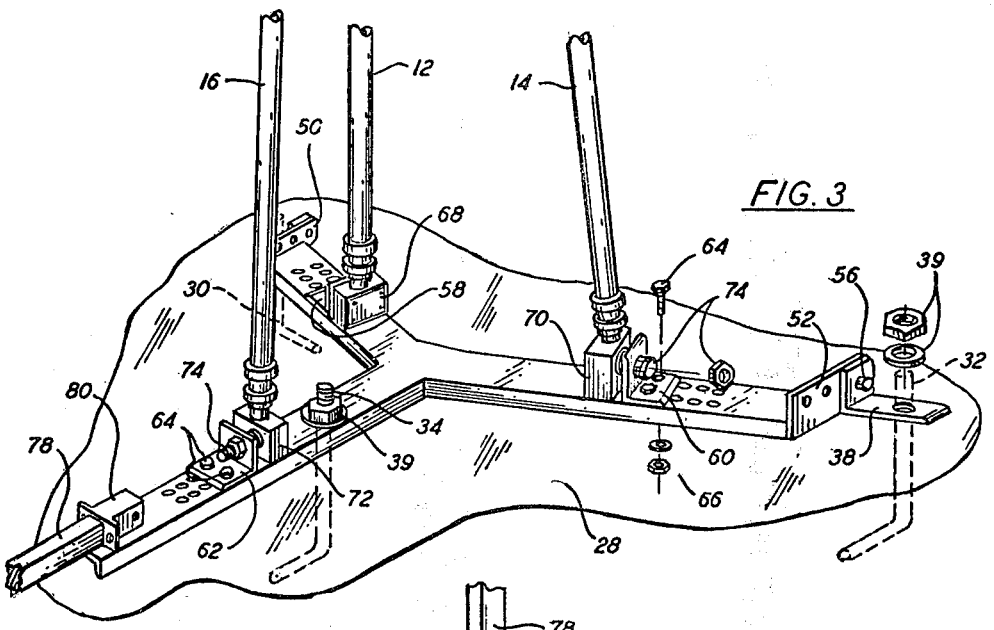
FIG. 3 is a perspective view of the base support assembly in a first position, showing a fragment of the lighting tower mounted thereon.
Figure 4:
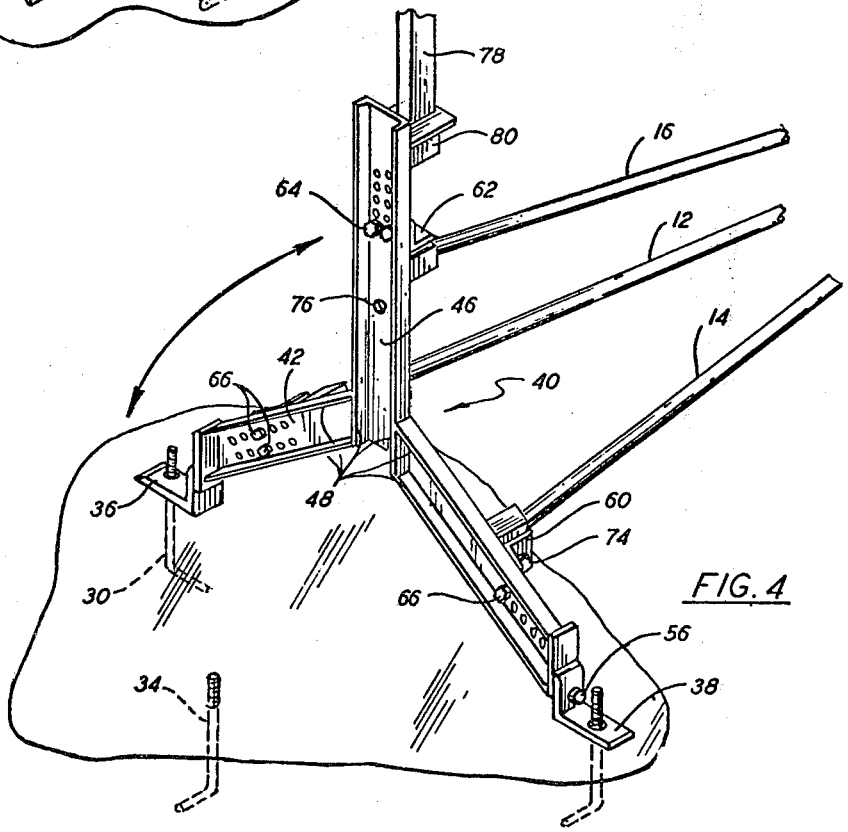
FIG. 4 is a perspective view of the base support assembly in a second position.

Member 40 is pivotally mounted upon anchored brackets 36 and 38 by means of pins 54 and 56 which extend through aligned openings in the brackets and in plates 50 and 52. Mounting brackets 58, 60 and 62 are secured to arms 42, 44 and 46, respectively, by bolts 64, which pass through aligned openings in the brackets and arms, and nuts 66. The lower ends of tower legs 12, 14 and 16 are fastened in conventional fashion to hollow boxes 68, 70 and 72, respectively, one or more of which may serve to house electrical connections or terminals for wires (not shown) passing through the hollow legs of the tower to lamps 22. Boxes 68, 70 and 72 are respectively connected by bolts and nuts 74 to brackets 58, 60 and 62, whereby tower 10 is rigidly connected to member 40. Thus, movement of member 40 about its pivotal mounting on pins 54 and 56, which lie on a common horizontal axis just forward of the lower ends of tower legs 12 and 14, moves tower 10 between its upright and lowered positions. As seen in FIG. 3, flanges 48 of member 40 are resting upon the horizontal upper surface of slab 28, with the axis of tower 10 vertical. Member 40 is shown in FIG. 4 rotated approximately 90°, or slightly less, from its first position, thereby placing tower 10 in its lowered position. It will be noted that the tower legs remain attached to member 40 at all times; although legs 12 and 14 will be placed in compression and leg 16 in tension as the tower is lowered and raised, the entire weight of the tower is not placed upon two pivotally mounted legs while the third is detached from its mounting.

Lug 34 is so positioned that the upper end thereof extends through opening 76 in arm 46 of member 40 when the latter is in its first position (FIG. 3). With nut 39 secured on the upper end of lug 34, tower 10 is firmly anchored in its upright position. Only the one nut must be removed in order to move member 40 and tower 10 away from this position. Lever arm or bar 78 may be inserted in housing 80, which is firmly secured to arm 46, to assist in manually moving the tower between its erected and lowered positions.

What is claimed is:

1. A base support installation for supporting a structure at three points and allowing pivotal movement about a horizontal axis, said installation comprising:

(a) a slab having an essentially planar, horizontal upper surface;

(b) a pair of anchor means fixedly attached to said slab and having portions extending upwardly from said upper surface thereof at a predetermined distance and orientation with respect to one another;

(c) a rigid, unitary, essentially Y-shaped, three armed member pivotally attached to both of said anchor means portions along a single horizontal axis and movable about said axis between a first position, wherein one side of said unitary member rests upon said upper slab surface, and a second position, wherein said unitary member is rotated about said axis substantially 90° with respect to said first position;

(d) means for releasably affixing said unitary member to said slab at a point removed from said axis when in said first position; and (e) three mounting brackets respectively connected to the three arms of said unitary member at spaced positions and extending from the side thereof opposite that which rests upon said slab in said first position, whereby a structure may be connected to said mounting brackets for pivotal movement with said unitary member about said axis.

2. The invention according to claim 1 wherein said unitary member is essentially Y-shaped.

3. The invention according to claim 2 wherein said unitary member is pivotally attached to said anchor means at two of its three extremities.

4. The invention according to claim 1 wherein said slab is concrete and said anchor means includes portions embedded in and extending out of said concrete.

5. The invention according to claim 4 wherein said means for releasably affixing includes an elongated member embedded in and extending out of said concrete.

6. The invention according to claim 5 wherein said elongated member extends through an opening in said unitary member in said first position thereof.

7. The invention according to claim 1 wherein said mounting brackets are equidistant from one another.

8. The invention according to claim 1 wherein said unitary member is pivotally attached to said anchor means at the extremities of two of its three arms, and said means for releasably affixing comprises an anchored, elongated member extending upwardly through an opening in the third arm in said first position of said unitary member.

9. A support system for a tripod-type structure having an elongated, central axis for movement of such structure between erected and lowered positions wherein said central axis is substantially vertically and horizontally disposed, respectively, said support system comprising:

(a) a fixed slab having an essentially planar, horizontal, upper surface;

(b) a rigid, unitary, member connected by anchor means to said slab for pivotal movement with respect thereto about a horizontal axis, perpendicular to said tripod central axis;

(c) three mounting brackets affixed to said unitary member at equally spaced positions thereon for respective connection to the three legs of said tripod-type structure;

(d) two of said brackets being positioned on a line parallel to said horizontal axis, the third of said brackets and said horizontal axis being positioned on opposite sides of said line; and (e) means for releasably affixing said unitary member to said slab at a single point on the same side of said line as said third bracket for securing said unitary member in a first position wherein said tripod axis is vertically disposed and releasable to permit movement of said unitary member about said horizontal axis to a second position wherein said tripod axis is horizontally disposed, all three tripod legs remaining connected to said mounting brackets during movement of said unitary member between said first and second positions thereof with the tripod legs connected to said two brackets being placed in compression and the leg connected to said third bracket being placed in tension during such movement.

* * * * *

UNITED STATES PATENT AND TRADEMARK OFFICE

CERTIFICATE OF CORRECTION

PATENT NO. : 4,413,455

DATED : November 8, 1983

INVENTOR(S) : Walter L. Jenkins

It is certified that error appears in the above-identified patent and that said Letters Patent is hereby corrected as shown below:

On the title page add:

--/73/ Assignee: Jaquith Industries, Inc.

Signed and Sealed this

*Thirty-first* Day of *January 1984*

[SEAL]

*Attest:*

GERALD J. MOSSINGHOFF

*Attesting Officer*

*Commissioner of Patents and Trademarks*